US006655606B2

(12) United States Patent
Earl

(10) Patent No.: US 6,655,606 B2
(45) Date of Patent: Dec. 2, 2003

(54) MULTIPLE NOZZLE TIP ASSEMBLY FOR AIRLESS PAINT SPRAYER GUN

(76) Inventor: Stephen R. Earl, 1952 N. 100 East, Orem, UT (US) 84057

( * ) Notice: Subject to any disclaimer, the term of this patent is extended or adjusted under 35 U.S.C. 154(b) by 229 days.

(21) Appl. No.: 09/904,087

(22) Filed: Jul. 12, 2001

(65) Prior Publication Data

US 2003/0010838 A1 Jan. 16, 2003

(51) Int. Cl.[7] ..... B05B 1/28; B05B 15/02; B05B 15/08

(52) U.S. Cl. ..... 239/104; 239/119; 239/288.3; 239/581.1; 239/581.2

(58) Field of Search ..... 239/104, 119, 239/288.3, 391, 393, 396, 436, 437, 438, 395, 600, 548, 566, 581.1, 581.2, 582.2

(56) References Cited

U.S. PATENT DOCUMENTS

| | | | | |
|---|---|---|---|---|
| 5,096,746 A | | 3/1992 | Strizki | |
| 5,232,739 A | | 8/1993 | Strizki | |
| 5,255,848 A | | 10/1993 | Rhodehouse | |
| 5,303,865 A | | 4/1994 | Bert | |
| 5,366,162 A | | 11/1994 | Strizki | |
| 5,379,939 A | * | 1/1995 | Perret, Jr. | 239/119 |
| 5,749,528 A | * | 5/1998 | Carey et al. | 239/119 |
| 5,893,522 A | * | 4/1999 | Kieffer | 239/600 |
| 6,502,763 B1 | * | 1/2003 | McCann | 239/119 |

* cited by examiner

*Primary Examiner*—Davis Hwu
(74) *Attorney, Agent, or Firm*—Angus C. Fox, III

(57) ABSTRACT

A spray tip assembly for airless paint sprayer guns incorporates a tip having multiple nozzles, each of which may be used independently. For a first embodiment of the invention the shaft of the spray tip assembly incorporates multiple spaced apart nozzles and a handle at one end thereof. The shaft also incorporates a spring-loaded detent ball which, in combination with a plurality of spaced-apart annular or semi-annular grooves in the housing bore, serves as a shaft locator for each of the nozzles. The grooves permit positioning of each of the nozzles in either a normal spraying position or in a reversed, unclogging position. For a second embodiment of the invention, the tip housing incorporates three spaced-apart annular channels, all three of which are interconnected by a tab-receiving slot shaped to admit a stop tab attached to the shaft. The stop tab may be indexed with any one of the channels, thereby serving to position the shaft so that each of the nozzles may be respectively and independently positioned for use.

9 Claims, 2 Drawing Sheets

MULTIPLE NOZZLE TIP ASSEMBLY FOR AIRLESS PAINT SPRAYER GUN

BACKGROUND OF THE INVENTION

1. Field of the Invention

This invention relates to airless paint sprayers and, more particularly, to the design of tips used in the spray guns of such sprayers.

2. Description of the Prior Art

A typical airless paint sprayer includes a pump, a suction tube having one end coupled to the pump inlet and the free end insertable in a container of paint, and a high-pressure hose that connects the pump outlet to a spray gun. Typically, a check valve is installed at the pump outlet. The spray gun has a trigger which, when depressed, opens a valve to allow pressurized paint in the hose to flow through a nozzle in the gun tip. The paint is atomized as it exits the nozzle, allowing a painter to evenly apply the paint to a surface. Although there are dozens of manufacturers of airless paint spraying equipment, the function of the equipment is basically the same. Differences in the available equipment usually relate to the design and output capacity of the pump. The three most common types of pumps used in airless paint sprayers are diaphragm pumps, piston pumps and gear pumps.

The capacity of pump unit, the high-pressure hose length, and the number of spray guns connected to the pump unit will determine the maximum tip size. A sprayer having an output capacity of ½ gallon per minute (gpm) can comfortably support a single spray gun using a tip nozzle in the 0.015 to 0.021-inch (about 0.38 to 0.53 mm) diameter range. Required pump capacity increases by about the square of the nozzle size.

Referring now to FIG. 1, a spray gun 100 used in combination with airless paint spraying systems typically has a hollow, pistol-shaped body 101. The body 100 incorporates a handle 102, a squeezable trigger 103, a trigger guard 104, and an internal valve assembly 105, controlled by the trigger 103, that controls the flow of paint to an output barrel 106. The handle 102 typically doubles as a housing for a removable screen filter (not shown). At the bottom of the handle 102 is a threaded coupling 107, to which the high-pressure hose from the pump unit may be attached. Attached to the end 108 of the output barrel 106 is a spray tip assembly 109.

Referring now to FIGS. 2 through 6, a typical spray tip assembly 109 includes a tip housing 201 having, at a first end thereof, a connector 202 that attaches to the end 108 of the output barrel and, at a second end thereof, a spray guard 203 that reduces the possibility of that a user of the equipment will inject paint into his body through the skin. The tip housing 201 generally incorporates a cylindrical bore 204 that is sized to receive a cylindrical shaft 301, that is generally referred to as a spray tip. At the mouth of the cylindrical bore 204 on one side of the tip housing 201 is a semicircular recess 205. When the spray tip assembly 109 is installed on the spray gun 100, the cylindrical bore 204 is perpendicular to the axis 401 of the gun output barrel 106. The cylindrical shaft 301 is sized for slidable entry into the cylindrical bore 204, with minimal clearance so as to prevent leakage of paint between the cylindrical surface of the shaft 301 and the cylindrical surface of the bore 204. For this particular prior art spray tip assembly 109, the cylindrical shaft 301 is secured within the bore 204 with a semicircular spring clip 501.

Still referring to FIGS. 2 through 6, the shaft 301 incorporates a single nozzle 302, the axis of which is perpendicular to the axis 303 of the shaft 301. At one end thereof, the shaft incorporates a handle 304, which facilitates both removal of the of the shaft 301 from the tip housing 201 and rotation of the shaft 301 to reverse the nozzle 302 should it become clogged. The handle 304 may incorporate a stop 305 which, in combination with the semicircular recess 205, allows the shaft 301 to be rotated only within an arc of 180 degrees. At one end of the arc, the nozzle 302 is positioned for spraying; at the other end of the arc, the nozzle 302 is positioned for unclogging.

Professional painters typically use several interchangeable tips of different sizes and/or different spray patterns at the same job site, the size and pattern of the tip being dictated by the particular application. For example, a tip with a 0.035-inch-diameter nozzle might be used for rapid application of latex base coats, while a tip with a 0.015-inch-diameter nozzle might be used for the painting of trim. In order to change to a different tip, the installed tip must be removed and stored for future use, and the desired tip installed in its place. The need to switch tips affords an opportunity for uninstalled tips to become lost. As the retail cost of each tip is about $US 30, the loss of multiple tips equates to a significant needless expense. There is also an additional economic waste related to the time required to switch out the tips.

U.S. Pat. No. 5,255,848 to Nolin C. Rhodehouse discloses a multiple orifice spray tip having reversible orifice cleaning capability for use with airless paint sprayers. A first embodiment spray tip offers first or second orifice by vertical movement of an orifice selection cylinder, while a second embodiment offers selection of a first or second orifice by rotation of the orifice selection cylinder about a vertical axis. There is a major disadvantage with each of these embodiments. The first embodiment requires an indexing tab to be attached with a screw at the end opposite the handle. This screw and indexing tab are problematic for two reasons. First, a screwdriver or other similar assembly tool is required to remove the spray nozzle. Therefore, the screwdriver must be carried to jobs and stored in a secure location. Secondly, construction sites are seldom neat and without clutter. Thus, if either the screw or the tab is dropped during disassembly or assembly, there is a fair likelihood that it will not be recovered. The disadvantage of the second embodiment is that tip manufacture is complicated by the nonlinear paths which the paint must take for each orifice. The additional complication will inevitably lead to production costs which are greater than for a tip which may be manufactured in a more straightforward manner. In addition, the nonlinear paint paths may affect the evenness or symmetricalness of the spray pattern.

Also available on the market is a product called DoubleShot®, which is a tip having two identically-sized orifices. Installation of a collar on the tip permits the orifice farthest removed from the handle to be used. Once the collar is removed, the orifice nearest the handle may be used. This product, however, does not address the need for multiple orifices of different sizes.

What is needed is a spray gun for airless paint sprayers which permits rapid changeover of spray nozzles without tools and, which does not require removable fasteners or other small parts which are readily misplaced or lost, and which permits both single and multiple orifice spray nozzle to be used with the same spray gun and tip guard.

SUMMARY OF THE INVENTION

The present invention provides a new spray tip assembly that may be used in combination with conventional spray guns for airless paint sprayers. The spray tip assembly incorporates a tip having multiple nozzles, each of which may be used independently. Several embodiments of the invention are contemplated.

For a first embodiment of the invention the shaft of the spray tip assembly incorporates multiple spaced apart nozzles and a handle at one end thereof. The shaft also incorporates a spring-loaded detent ball. The tip housing has a bore with a plurality of spaced-apart annular or semi-annular grooves, each of which, in conjunction with the spring-loaded detent ball, serves as a shaft locator for each of the nozzles. The grooves permit positioning of each of the nozzles in either a normal spraying position or in a reversed, unclogging position.

For a second embodiment of the invention, the tip housing incorporates three spaced-apart annular channels, all three of which are interconnected by a slot shaped to admit a stop tab attached to the shaft. More accurately, the outermost channel is really a semicircular recess, shown in the prior art description as item 205, as it is open on one side. The stop tab may be indexed with any one of the channels, thereby serving to position the shaft so that each of the nozzles may be respectively and independently positioned for use.

DETAILED DESCRIPTION OF THE INVENTION

The present invention provides a new spray tip assembly that may be used in combination with prior art spray guns for airless paint sprayers. The spray tip assembly incorporates a tip having multiple nozzles, each of which may be used independently. Several embodiments of the invention are contemplated, each of which will now be described with reference to the attached drawing figures.

Figures 1, 2, 3, 4, 5, 6:
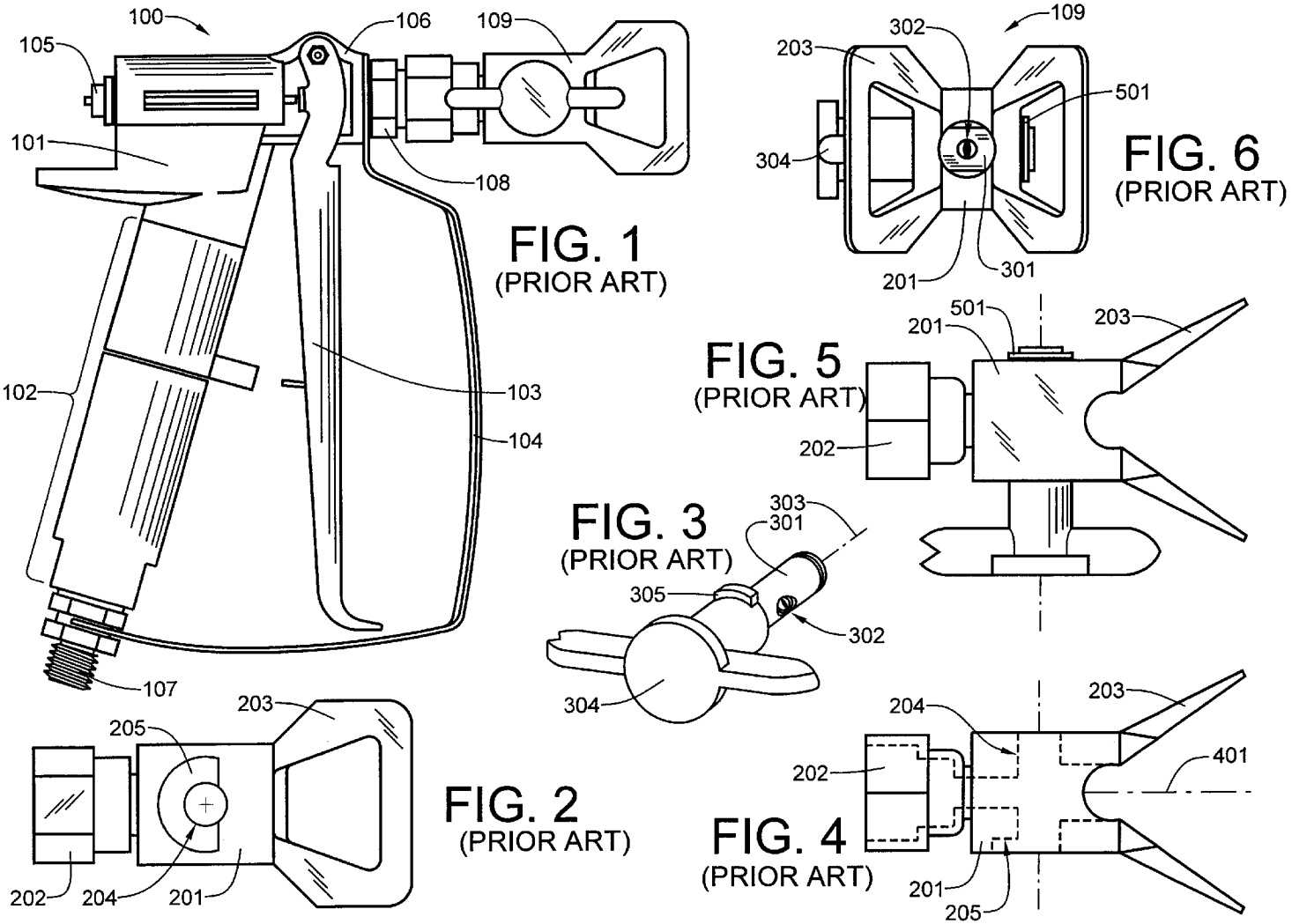
FIG. 1 (PRIOR ART)
FIG. 2 (PRIOR ART)
FIG. 3 (PRIOR ART)
FIG. 4 (PRIOR ART)
FIG. 5 (PRIOR ART)
FIG. 6 (PRIOR ART)
FIG. 1 is a right-side elevational view of a typical prior art spray gun for an airless paint sprayer system.
FIG. 2 is an enlarged right side elevational view of the spray tip assembly of the spray gun of FIG. 1, with the spray tip removed.
FIG. 3 is an isometric view of a prior art single-nozzle spray tip.
FIG. 4 is a top plan see-through view of the spray tip assembly of the spray gun of FIG. 1, with the spray tip removed.
FIG. 5 is a top plan view of the spray tip assembly of the spray gun of FIG. 1, with the spray tip of FIG. 3 installed therein.
FIG. 6 is a front elevational view of the spray tip assembly of the spray gun of FIG. 1, with the spray tip of FIG. 3 installed therein.
Figure 8:
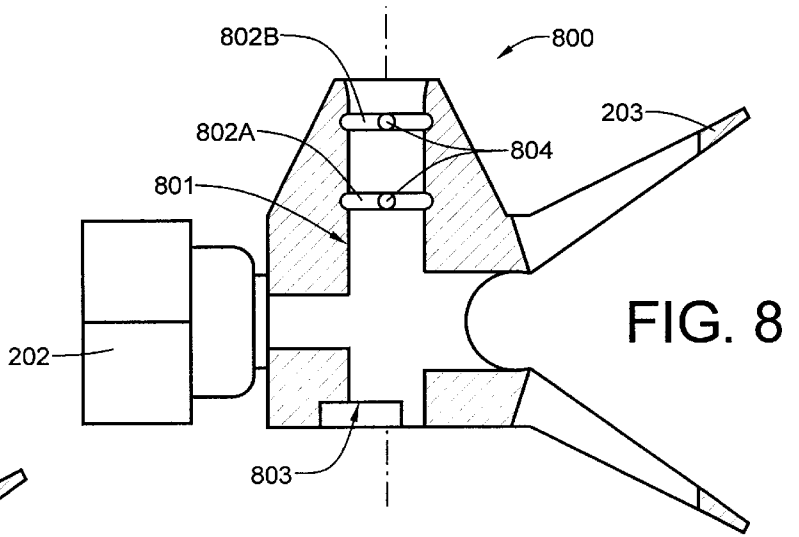
FIG. 8 is a top cross-sectional plan view of a first embodiment spray tip housing for use in combination with the spray tip of FIG. 7, taken through the axes of the cylindrical tip receiving bore and of the paint inlet opening.
Figure 10:
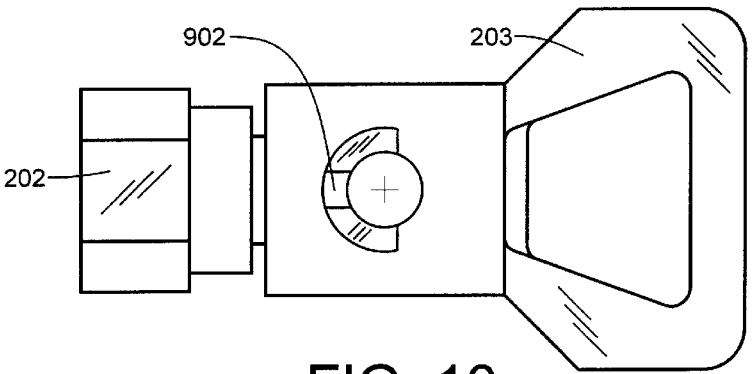
FIG. 10 is a side elevational view of the second embodiment spray tip housing of FIG. 9.
Figure 7:
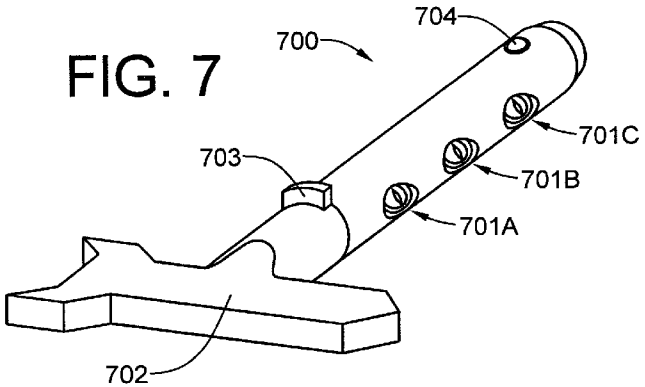
FIG. 7 is an isometric view of a three-nozzle spray tip manufactured in accordance with the present invention.
Figure 9:
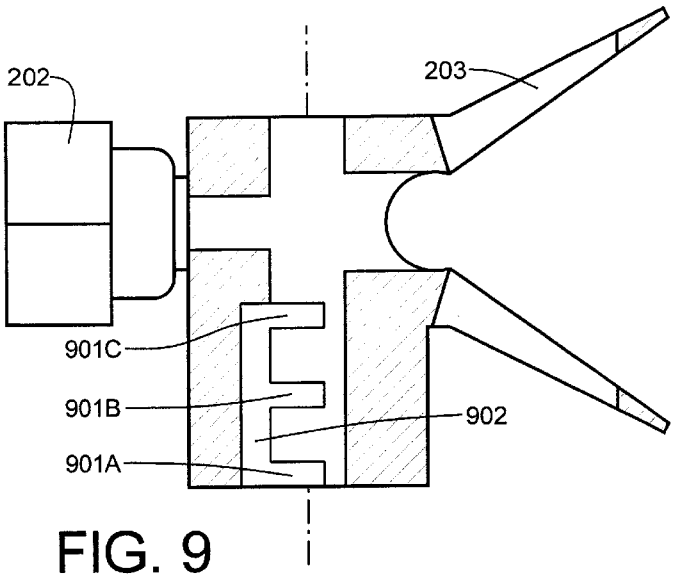
FIG. 9 is a is a top cross-sectional plan view of a second embodiment spray tip housing for use in combination with the spray tip of FIG. 7, taken through the axes of the cylindrical tip receiving bore and of the paint inlet opening.

Referring now to FIG. 7, a main embodiment multiple-nozzle spray tip shaft 700 manufactured in accordance with the present invention incorporates three aligned, spaced apart nozzles 701A, 701B and 701C and a preferably non-removable handle 702 at one end thereof. The handle preferably incorporates a rotational stop tab 703. The shaft 700 may also incorporate a spring-loaded detent ball 704. The first embodiment spray tip shaft 700 may be used in combination with either the first embodiment spray tip housing 800 of FIG. 8 or the second embodiment spray tip housing 900 of FIGS. 9 and 10.

In the case of the combination of the first embodiment spray tip shaft 700 with the first embodiment housing 800, the housing has a bore 801 equipped with a plurality of spaced-apart annular or semi-annular grooves 802A and 802B, each of which, in conjunction with the spring-loaded detent ball 704, serves as a shaft locator for nozzles 701A and 701B, respectively. A semicircular recess 803, in combination with the handle 702 and rotational stop tab 703, serves to position nozzle 701C. The grooves 802A and 802B permit positioning of each of the nozzles 701A and 701B in either a normal spraying position or in a reversed, unclogging position. Each of the grooves 802A and 802B may have a pair of depressions 804 (only one of which is shown for each groove), that are somewhat deeper than the grooves 802 for indexing the spraying and unclogging positions of the shaft 700.

In the case of the combination of the first embodiment spray tip shaft 700 with the second embodiment housing 900, the housing incorporates three spaced-apart annular channels 901A, 901B and 901C, all three of which are interconnected by a slot 902 shaped to admit the stop tab 703. More accurately, the outermost channel 901A is really a semicircular recess, shown in the prior art description as item 205, as it is open on one side. The stop tab 703 may be indexed with one of the channels 901A, 901B or 901C, thereby serving to position the shaft 700 so that each of the nozzles 701A, 701B and 701C may be respectively and independently positioned for use in a normal orientation for spraying, or a reversed orientation for unclogging.

Although only several embodiments of the invention has been heretofore described, it will be obvious to those having ordinary skill in the art that changes and modifications may be made thereto without departing from the scope and the spirit of the invention as hereinafter claimed.

What is claimed is:

1. A spray tip assembly for use in combination with a spray gun of an airless paint spraying system, said spray tip assembly comprising:

a spray tip housing, having a bore perpendicular to a direction of escape for paint from the gun, said bore equipped with multiple spacedapart semi-annular indexing channels, each of said channels having an outer periphery Interconnected by a slot;

a generally cylindrical tip shaft insertable within said bore, said tip shaft having at least one spray nozzle associated with a single indexing channel, each nozzle being usable independently of any other nozzle on the same tip shaft;

a handle rigidly affixed to one end of the tip shaft, said handle facilitating the rotation of the shaft to reverse the direction of each nozzle within the spray tip assembly so that, if necessary, it may be unclogged, said handle also indicating whether the nozzle is pointed forward for spraying, or is reversed; and a rotational stop and index tab spaced away from the handle and rigidly affixed to the tip shaft, said tab insertable through said slot and indexable within any of the semi-annular indexing channels, the positioning of the tab within a single channel being associated with the positioning of a single nozzle for use in both normal and reversed directions, said stop and index tab permitting the shaft to be reversibly and axially rotated through no more than one-half of a full revolution.

2. The spray tip assembly of claim 1, which further comprises a spray nozzle associated with each index position.

3. The spray tip assembly of claim 2, wherein said tip shaft incorporates a spring-loaded detent ball, and said bore is equipped with a plurality of spaced-apart annular or semi-annular radial grooves, each of which, in conjunction with the spring-loaded detent ball, serves to maintain the tab aligned with an indexing channel when it rotates through that channel's passageway opening.

4. A spray tip assembly for an airless paint sprayer gun, said tip comprising:

a housing sealably mountable to the output barrel of the gun, said housing having an aperture axially aligned with the output barrel and a cylindrical bore intersecting the aperture perpendicularly to an intended direction of spray output, said bore equipped with multiple semi-annular indexing channels spaced apart along the axis of the bore, each of said channels interconnected by a tab-receiving slot;

a generally cylindrical tip shaft incorporating multiple spaced-apart nozzles, each of which is usable independently of the other, said tip shaft being slidably insertable and axially rotatable within said bore;

a handle rigidly affixed to one end of the tip shaft, said handle facilitating both the slidable positioning of the shaft and the rotation of thereof to reverse the direction of each nozzle within the spray tip assembly so that, if necessary, it may be unclogged, said handle also indicating whether the nozzle is pointed forward for spraying, or is reversed; and a rotational stop and Index tab spaced away from the handle and rigidly affixed to the tip shaft, said tab insertable through said slot and indexable within any of the semi-annular indexing channels, the positioning of the tab within a single channel being associated with the positioning of a single nozzle for use in both normal and reversed directions, said stop and index tab permitting the shaft to be reversibly and axially rotated through no more than one-half of a full revolution.

5. The spray tip assembly of claim 4, wherein said tip shaft incorporates a spring-loaded detent ball, and said bore is equipped with a plurality of spaced-apart annular or semi-annular radial grooves, each of which, in conjunction with the spring-loaded detent ball, serves as a shaft locator for positive selection of individual indexing channels.

6. A spray tip assembly for an airless paint sprayer gun, said tip comprising:

a housing sealably mountable to the output barrel of the gun, said housing having an aperture axially aligned with the output barrel and a cylindrical bore intersecting the aperture perpendicularly to an intended direction of spray output, said bore equipped with multiple indexing means spaced apart along the axis of the bore;

a generally cylindrical tip shaft incorporating multiple spaced-apart nozzles, each of which is usable independently of the other, said tip shaft being slidably insertable and axially rotatable within said bore;

a handle rigidly affixed to one end of the tip shaft, said handle facilitating both the slidable positioning of the shaft and the rotation of thereof to reverse the direction of each nozzle within the spray tip assembly so that, if necessary, it may be unclogged, said handle also Indicating whether the nozzle is pointed forward for spraying, or is reversed; and engaging means incorporated within the tip shaft, said engaging means engaging said indexing means to axially position a single nozzle in both normal and reversed directions, said engaging means also providing for axial rotation of the shaft between normal and reversed nozzle directions.

7. The spray tip assembly of claim 6, wherein said indexing means comprises a plurality of spaced-apart annular or semi-annular radial grooves in said bore, and said engaging means comprises a spring-loaded detent ball incorporated within said tip shaft at a fixed position on its periphery, said detent ball engageable with any of said radial grooves, so as to provide axially positioning of each nozzle.

8. The spray tip assembly of claim 6, wherein said indexing means comprises a plurality of semi-annular indexing channels incorporated into and spaced apart along the axis of said bore, each of said channels interconnected by a tab-receiving slot, and said engaging means comprises a rotational stop and index tab spaced away from the handle and rigidly affixed to the tip shaft, said tab insertable through said slot and indexable within any of the semi-annular indexing channels, the positioning of the tab within a single channel being associated with the positioning of a single nozzle for use in both normal and reversed directions, said stop and index tab permitting the shaft to be reversibly and axially rotated through no more than one-half of a full revolution.

9. The spray tip assembly of claim 6, wherein said tip shaft incorporates a spring-loaded detent ball at a fixed position on its periphery, and said bore is equipped with a plurality of spaced-apart annular or semi-annular radial grooves, each of which, in conjunction with the spring-loaded detent ball, serves as a shaft locator for positive positioning of the shaft when said tab is aligned with said tab-receiving slot.

* * * * *